US008544180B2

(12) United States Patent
Minica

(10) Patent No.: US 8,544,180 B2
(45) Date of Patent: Oct. 1, 2013

(54) OPACITY CHANGING PEEP SIGHT

(76) Inventor: Stuart Minica, La Vernia, TX (US)

( * ) Notice: Subject to any disclaimer, the term of this patent is extended or adjusted under 35 U.S.C. 154(b) by 177 days.

(21) Appl. No.: 13/311,535

(22) Filed: Dec. 5, 2011

(65) Prior Publication Data

US 2012/0137529 A1 Jun. 7, 2012

Related U.S. Application Data

(60) Provisional application No. 61/420,316, filed on Dec. 6, 2010.

(51) Int. Cl.
*F41G 1/467* (2006.01)

(52) U.S. Cl.
USPC ..... 33/265; 124/90

(58) Field of Classification Search
USPC ..... 33/265; 124/87, 90
See application file for complete search history.

(56) References Cited

U.S. PATENT DOCUMENTS

| | | | | |
|---|---|---|---|---|
| 5,157,839 | A | 10/1992 | Beutler | |
| 5,860,408 | A * | 1/1999 | Summers | 124/87 |
| 5,996,569 | A | 12/1999 | Wilson | |
| 6,058,921 | A | 5/2000 | Lawrence et al. | |
| 6,981,329 | B1 | 1/2006 | Strathman | |
| 7,040,027 | B1 * | 5/2006 | Shaffer et al. | 33/265 |
| 7,290,345 | B2 * | 11/2007 | Ellig | 33/265 |
| 7,543,389 | B2 * | 6/2009 | Grace, Jr. | 33/265 |
| 7,621,055 | B1 * | 11/2009 | Brooks | 33/265 |
| 8,201,339 | B1 * | 6/2012 | Walker | 33/265 |
| 2007/0227018 | A1 * | 10/2007 | Ellig | 33/265 |
| 2009/0114203 | A1 * | 5/2009 | Sterner et al. | 124/87 |
| 2009/0144994 | A1 * | 6/2009 | Taboada et al. | 33/265 |
| 2013/0081292 | A1 * | 4/2013 | LoRocco | 33/265 |

* cited by examiner

*Primary Examiner* — G. Bradley Bennett
(74) *Attorney, Agent, or Firm* — Taboada Law Firm, PLLC; John M. Taboada

(57) ABSTRACT

An opacity changing peep sight device is disclosed wherein the peep sight comprises a photochromic substance sensitive to UV light. When there is plenty of available UV light, the peep sight becomes substantially opaque. When there is little available UV light, the peep sight becomes substantially translucent. Other embodiments are described and claimed.

15 Claims, 1 Drawing Sheet

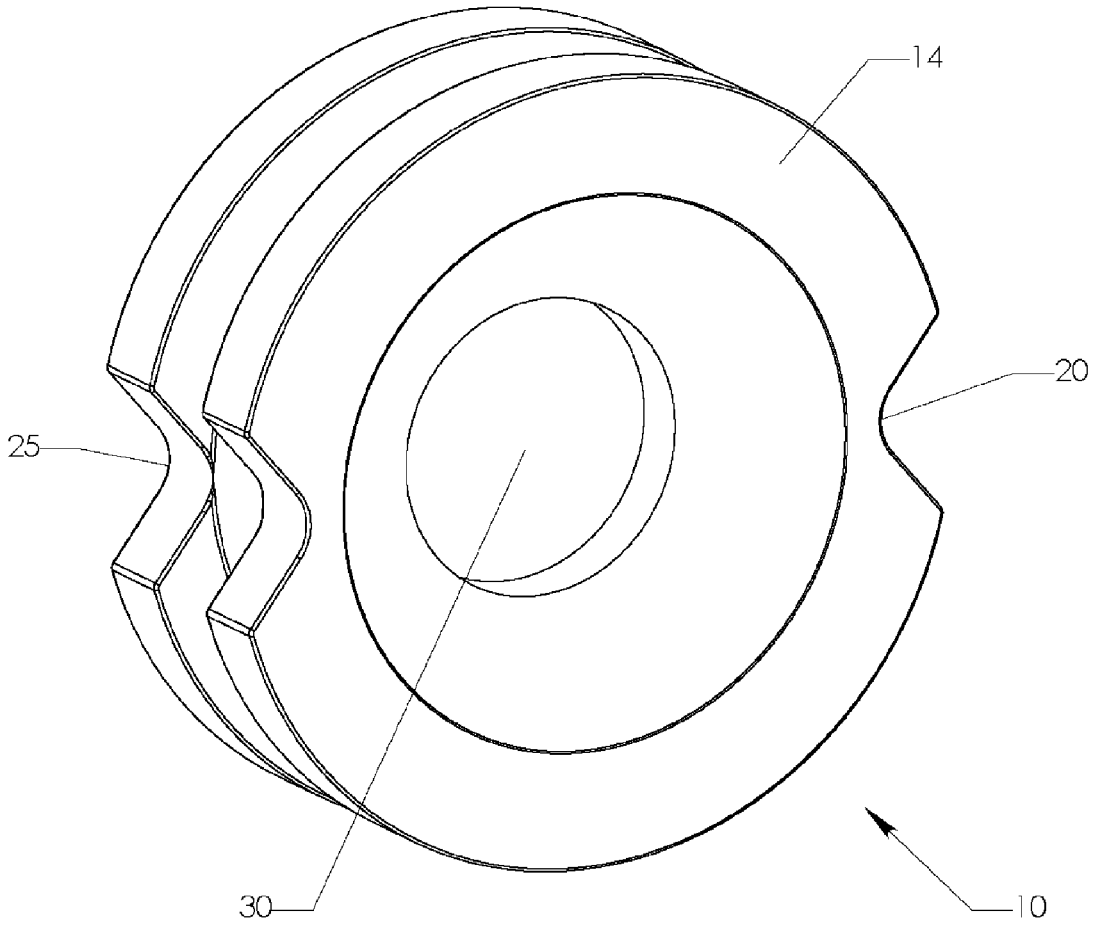
14
20
25
30
10

OPACITY CHANGING PEEP SIGHT

I. CROSS REFERENCE TO RELATED APPLICATIONS

This application CLAIMS PRIORITY to U.S. Provisional Patent Application Ser. No. 61/420,316 filed on Dec. 6, 2010, which is incorporated herein by reference in its entirety.

II. BACKGROUND

The invention relates generally to the field of archery and the problem of being able to see a target when looking through a peep sight in low light conditions. More specifically, this invention relates to a peep sight device that changes opacity in order to help an archer see a target better when aiming through a peep sight in low light conditions.

A peep sight is a rear reference point to help aim a bow. A peep sight is usually attached to the bowstring and is essentially a hole which you look through to assist in aiming. While it is possible to shoot a bow without a peep sight, it can be difficult to draw the bow back to the same location, or anchor point, which can result in less accuracy. Peep sights are very common and most archers use them as they allow the archer to aim faster and more accurately.

One drawback with peep sights is that they can be difficult to see through when shooting a bow in low light conditions. Low light conditions are especially common when hunting with a bow as most hunting occurs at sunrise or sunset. In these low light situations, a common problem is that the archer can see the target when not looking through the peep, but when the archer draws and tries to aim the bow and look through the peep then he can no longer see his target. This is partially due to the hole in the peep which constricts the sight window, but it is also due to the fact that most peeps are made from opaque materials that do not allow light to transmit through the peep. An opaque material blocks the amount of available light that is reflected off the target, making it difficult for the archer to see the target.

Often times bow hunters will try to enhance their low light viewing through their peep sight by drilling out and enlarging the hole in their peep sight. This does help some, but also leads to less accuracy as a larger hole provides more room for error at the rear reference aiming point. The peep sight material remains opaque so the peep still blocks available light.

There are many previous peep sight designs, but few have tried to solve this problem of losing your target in low light conditions. Examples would include U.S. Pat. No. 5,996,569 issued Dec. 7, 1999 to Keith W. Wilson and U.S. Pat. No. 6,981,329 issued Jan. 3, 2006 to David Michael Strathman. These peep sights add light gathering fiber optic material in the peep sight. While these peeps sights do gather more light with the fiber optic, they are only gathering general light. In order for the archer to be able to see the animal or target, the archer's eye needs to better see the small amount of light which is reflected off the target. A peep sight with fiber optics helps to see your peep, it does not help to see your target. Not only does the light gathered by fiber optics not help in seeing the target, but it could be distracting or blinding, making it more difficult to see your target. General light that is gathered within the peep sight can have the reverse effect of drowning out and overcoming the small amount of light that is reflecting off the target. This is the equivalent of trying to look around in a dark room and then somebody shines a flashlight directly in your eyes. The light from the flashlight is distracting and blinding and does not help you see around the room. The unwanted light makes your pupils constrict, making the objects in low light harder to see.

Another device is U.S. Pat. No. 5,157,839 issued Oct. 27, 1992 to Robert C. Beutler. The Beutler device attempts to solve the low light problem by adding artificial, battery powered light in the peep sight itself. While the battery powered light does add more light in the peep, it is only general light and not light reflected from your target. In order for the archer to be able to see the animal or target, the archer's eye needs to better see the small amount of light which is reflected off the target. An illuminated peep sight helps to see your peep, it does not help to see your target. Additionally, the artificial light could be distracting or blinding. Light that is artificially produced in the peep sight can have the reverse effect of drowning out and overcoming the small amount of light that is reflecting off the target. This is the equivalent of trying to look around in a dark room and then somebody shines a flashlight directly in your eyes. The light from the flashlight is distracting and blinding and does not help you see around the room. The unwanted light makes your pupils constrict, making the objects in low light harder to see.

U.S. Pat. No. 6,058,921 issued May 9, 2000 to David J. Lawrence and Terry R. Whitford has a substantially transparent material with a colored contrast ring. The colored contrast ring is useful in well lighted conditions because the transparent material is difficult to see through in well lighted conditions as it can result in a lot of glare and a halo effect when looking through it in bright light. When there is bright light, the colored contrast ring is easy to see through. However, the colored contrast ring is not useful in low light conditions as the added pigment of color blocks some of the small amount of light that is reflecting off the target, and prevents some from reaching the archers eye. This system would be ideal if it could have the colored contrast ring when in bright light and no colored ring when in low light conditions, but it cannot unless it was constructed where the archer could remove the colored contrast ring but that is not practical in every hunting situation.

The embodiment or embodiments described herein may solve these shortcomings as well as others by proposing a novel peep sight device that will change opacity with photochromic activity. The peep sight of the present invention will turn dark in well lighted conditions to prevent glare and to provide contrast, yet will change to substantially transparent in low light conditions thus allowing more light reflected from the target to reach the archer's eye.

III. SUMMARY

Disclosed is a peep sight device comprising a peep body comprising a front surface, a back surface, and a bowstring attachment portion; and a photochromic substance.

Numerous additional embodiments are also possible.

IV. BRIEF DESCRIPTION OF THE DRAWINGS

Other objects and advantages of the invention may become apparent upon reading the detailed description and upon reference to the accompanying drawings.

FIG. 1 is a side perspective of the peep sight device, in accordance with some embodiments.

While the invention is subject to various modifications and alternative forms, specific embodiments thereof are shown by way of example in the drawings and the accompanying detailed description. It should be understood, however, that the drawing and detailed description are not intended to limit the invention to the particular embodiments. This disclosure is instead intended to cover all modifications, equivalents, and alternatives falling within the scope of the present invention as defined by the appended claims.

V. DETAILED DESCRIPTION

One or more embodiments of the invention are described below. It should be noted that these and any other embodiments are exemplary and are intended to be illustrative of the invention rather than limiting. While the invention is widely applicable to different types of systems, it is impossible to include all of the possible embodiments and contexts of the invention in this disclosure. Upon reading this disclosure, many alternative embodiments of the present invention will be apparent to persons of ordinary skill in the art.

The invention relates generally to the field of archery and the problem of being able to see a target when looking through a peep sight in low light conditions. More specifically, this invention relates to a peep sight device that changes opacity in order to help an archer see a target better when aiming through a peep sight in low light conditions.

FIG. 1 illustrates one embodiment of the present invention. FIG. 1 shows a side perspective view of the peep sight device 10 of the present invention. The peep sight device 10 comprises a front surface 14 closest to the archer's eye, a back surface (not visible in the perspective of FIG. 1) furthest from the archer's eye, portions 20 and 25 for attaching to a bowstring, an aperture 30 for the archer to look through, and a photochromic substance.

The peep sight 10 is composed of a substantially translucent material. The bowstring, not shown, attaches to the portions 20 and 25 of the peep sight 10. When the archer is aiming in conditions with ambient UV light, the photochromic substance is activated by the UV light to change color and thus opacity. This makes the peep sight darker and less translucent. However, when the archer is aiming in low light conditions, the photochromic substance is not activated due to the lower UV light levels and the opacity of the peep changes back to substantially translucent. In this embodiment, the photochromic substance is integrated into the material of the peep sight during the plastic injection molding of the peep sight.

In another embodiment, instead of the photochromic substance integrated into the material of the peep sight, the photochromic substance may be coated on the surface of the peep sight. The photochromic substance may be coated over substantially the entire surface of the peep sight or just over some of the surface of the peep sight, such as just the front surface 14. Alternatively, in another embodiment, the photochromic substance may be coated over only a portion of the peep sight in order to create a colored contrast band on the peep sight similar to that of Lawrence et al. of U.S. Pat. No. 6,058,921.

In another embodiment, the peep sight has both a photochromic substance integrated into the material of the peep sight and a photochromic substance coated on either, part of the surface of the peep sight or substantially the entire surface of the peep sight.

In another embodiment, the peep sight may not have an air opening or aperture 30 in the middle as shown in FIG. 1 and instead would be composed of the same material as that of the peep sight. Having this closed peep sight body allows the application of the photochromic substance through the aperture region as well, in either a photochromic coating, a photochromic substance integrated into the material of the peep sight, or both.

In another embodiment, the peep sight comprising a photochromic substance may be polarized as well as anti-reflective coated.

The photochromic color change is possible via many options and is taught by many patents, including but not limited to U.S. Pat. Nos. 5,266,447, 6,547,390, 7,189,456 and 7,261,843.

In another embodiment, the front surface may be designed to be substantially opaque irrespective of the UV exposure. In order to reduce the amount of glare into the archer's eye, the front surface may be substantially opaque regardless of the UV exposure. The front surface may be a darkened or matte surface. The darkened or matte surface may cover all of the front surface or just a region of the front surface.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The benefits and advantages that may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A peep sight comprising:

a peep body comprising a front surface, a back surface, and a bowstring attachment portion; and a photochromic substance.

2. The peep sight of claim 1, wherein the photochromic substance is coated on at least one peep body surface.

3. The peep sight of claim 1, wherein the photochromic substance is integrated within the peep body.

4. The peep sight of claim 1, wherein the photochromic substance is coated in a band on at least one peep body surface.

5. The peep sight of claim 1, wherein the peep body further comprises a polarization coating across at least one peep body surface.

6. The peep sight of claim 1, wherein the peep body further comprises an anti-reflective coating across at least one peep body surface.

7. The peep sight of claim 1, wherein the front surface is substantially opaque irrespective of UV exposure.

8. A peep sight comprising:

a peep body comprising a front surface, a back surface, an aperture portion, and a bowstring attachment portion; and a photochromic substance.

9. The peep sight of claim 8, wherein the aperture portion comprises a circular opening extending from the front surface to the back surface.

10. The peep sight of claim 8, wherein the photochromic substance is coated on at least one peep body surface.

11. The peep sight of claim 8, wherein the photochromic substance is integrated within the peep body.

12. The peep sight of claim 8, wherein the photochromic substance is coated in a band around the aperture portion on at least one peep body surface.

13. The peep sight of claim 8, wherein the peep body further comprises a polarization coating across at least one peep body surface.

14. The peep sight of claim 8, wherein the peep body further comprises an anti-reflective coating across at least one peep body surface.

15. The peep sight of claim 8, wherein the front surface is substantially opaque irrespective of UV exposure.

* * * * *